US006928944B2

(12) United States Patent
Stoll

(10) Patent No.: US 6,928,944 B2
(45) Date of Patent: Aug. 16, 2005

(54) PROTECTIVE BUMPER FOR TOWBOATS

(75) Inventor: Richard D. Stoll, Chesapeake, OH (US)

(73) Assignee: Richwood Industries, Inc., Huntington, WV (US)

( * ) Notice: Subject to any disclaimer, the term of this patent is extended or adjusted under 35 U.S.C. 154(b) by 56 days.

(21) Appl. No.: 10/651,143

(22) Filed: Aug. 28, 2003

(65) Prior Publication Data

US 2005/0045086 A1 Mar. 3, 2005

(51) Int. Cl.[7] ..... B63B 59/02
(52) U.S. Cl. ..... 114/219; 267/140
(58) Field of Search ..... 114/219, 220; 267/140; 405/212, 215; 428/196

(56) References Cited

U.S. PATENT DOCUMENTS

| | | | | | |
|---|---|---|---|---|---|
| 1,981,182 | A | * | 11/1934 | Lyons | 114/219 |
| 2,307,255 | A | * | 1/1943 | Bell | 114/219 |
| 2,799,494 | A | * | 7/1957 | Pollock | 267/140 |
| 3,014,710 | A | | 12/1961 | Layne | |
| 3,338,206 | A | | 8/1967 | Motter | |
| 3,616,126 | A | * | 10/1971 | Tungseth | 428/86 |
| 3,684,272 | A | * | 8/1972 | Ticknor | 267/140 |
| 3,918,384 | A | | 11/1975 | Blose | |
| 4,636,423 | A | * | 1/1987 | Reid | 428/196 |
| 4,679,517 | A | | 7/1987 | Kramer | |
| 4,848,969 | A | | 7/1989 | Murota et al. | |
| 4,854,258 | A | | 8/1989 | Hausmann et al. | |
| 5,074,407 | A | * | 12/1991 | Brumby | 267/140 |
| 5,174,221 | A | | 12/1992 | Enami et al. | |
| 5,727,493 | A | | 3/1998 | Pierce | |
| 5,791,278 | A | | 8/1998 | Orndorff, Jr. | |
| 5,839,854 | A | | 11/1998 | Streszoff et al. | |
| 6,050,211 | A | * | 4/2000 | Yamaguchi | 114/219 |
| 6,120,871 | A | | 9/2000 | De Biase | |
| 6,148,754 | A | | 11/2000 | Sims, Jr. | |
| 6,155,192 | A | | 12/2000 | Yamaguchi | |
| 2002/0174816 | A1 | | 11/2002 | Barmakian et al. | |
| 2003/0019415 | A1 | | 1/2003 | Leemon | |

OTHER PUBLICATIONS

Material from website http://www.metsominerals.com entitled Ship Fenders, Copyright 2003 Metso Minerals Oy, member of Metso Corporation.

* cited by examiner

*Primary Examiner*—Lars A. Olson
(74) *Attorney, Agent, or Firm*—Stevens & Showalter LLP

(57) ABSTRACT

A protective bumper structure for the exterior surface of tugboats or towboats. The protective bumper includes a backing member for supporting the bumper to the boat, a resilient cushion layer supported on the backing member and a protective face supported on the resilient cushion. The protective face is formed of a durable low friction material and is provided in the form of plural segments, such as spaced elongated strips extending along the length of the resilient cushion. The protective face provides an engagement surface for engaging a cooperating surface on a barge.

21 Claims, 5 Drawing Sheets

PROTECTIVE BUMPER FOR TOWBOATS

BACKGROUND OF THE INVENTION

1. Field of the Invention

The present invention relates to a protective structure for the exterior surface of boats and, more particularly, to a damage resistant impact absorbing structure for use on towboats or tugboats.

2. Description of Prior Art

River towboats or tugboats typically include bumpers comprising padded pusher knees formed of upright beams located on the front of the towboat for engaging and pushing barges. The bumpers generally include solid rubber members molded to a heavy steel backing plate. The rubber is typically two inches thick and the steel backing plate may be from one-quarter inch to one inch thick, depending on the requirements for the towboat.

The typical rubber compound is formed of either a natural rubber base with added fillers and carbon black producing a finished product of 60 Shore A hardness, or a similar hardness from an EPDM rubber compound. The metal plates of the bumpers are welded in place on the pusher knees to protect the towboat at locations where it will contact a barge.

Prior art solid rubber bumper constructions have several inherent problems. One problem associated with the prior bumpers relates to the inability of the bumper to resist shearing forces. Specifically, although the rubber compounds for the bumper are formulated to be relatively tough and resistant to abrasion and tearing, the extreme forces involved in shoving and positioning barges are often greater than the rubber is capable of withstanding. Accordingly, sideways or shearing forces may cause the rubber to be gouged or ripped from the steel backing plate if the bumper engages a barge or dock surface at an angle instead of engaging in direction that is generally perpendicular to the backing plate.

Additionally, rubber does not have naturally a slick or slippery surface characteristics, even when wet, such that when engaging a barge, the force of engagement between the towboat and barge will negate any lubricating effect the water may have between the surfaces. In some cases, the bumper may even become stuck to the barge. Further, various factors may affect the relative position between the towboat and the barge including changing winds and river currents, changes in the fuel load of the towboat, and a change in the number of barges being pushed, requiring repositioning of the rubber of the bumper relative to the barge. The described rubber bumper construction is not well suited to such changing conditions which alter the position of the towboat relative to the barge, in that the changing conditions subject the rubber bumper to shearing forces which tend to damage the bumper.

The current design of bumpers is also relatively heavy and difficult to handle in that a typical bumper member may comprise a one foot-by-three foot three-quarter inch plate having a two inch rubber molded element. This bumper construction, which may weigh over 120 pounds, is welded directly to the contact areas of the towboat. The heavy plate used for the bumper spans any dents and depressions in the supporting structure, i.e., the pusher knees, of the towboat.

There is a need for towboat bumper which is lightweight and durable to accommodate compressive and shearing forces applied against the bumper, and to resist gouging of the bumper surface.

SUMMARY OF THE INVENTION

A protective bumper structure for the exterior surface of tugboats or towboats. The protective bumper includes a backing member for supporting the bumper to the boat, a resilient cushion layer supported on the backing member and a protective face supported on the resilient cushion. The protective face is formed of a durable low friction material and is provided in the form of plural segments, such as spaced elongated strips extending along the length of the resilient cushion. The protective face provides an engagement surface for engaging a cooperating surface on a barge.

In accordance with one aspect of the invention, a protective bumper is provided for use on a towboat, the protective bumper comprising: a rigid backing member defining a longitudinal dimension and a lateral dimension for the protective bumper; a resilient cushion layer including an inner side attached to the backing member and an outer side facing outwardly from the backing member; and an outer protective face comprising a high hardness urethane material supported on the outer side of the resilient cushion layer wherein the outer protective face is segmented to define plural face segments.

In accordance with another aspect of the invention, a protective bumper is provided for use on a towboat, the protective bumper comprising: a rigid backing member defining a longitudinal dimension and a lateral dimension for the protective bumper; a resilient cushion layer formed of a rubber material, the resilient cushion layer including an inner side attached to the backing member and an outer side facing outwardly from the backing member; and an outer protective face comprising an ultra high molecular weight polyethylene material supported on the outer side of the resilient cushion layer wherein the outer protective face is segmented to define plural elongated strips extending along a direction of the longitudinal dimension, the elongated strips being spaced from each other in a direction of the lateral dimension on the outer side of the resilient cushion material.

In accordance with a further aspect of the invention, a protective bumper is provided for use on a towboat, the protective bumper comprising: a backing member comprising a plurality of rigid segments separated from each other in a longitudinal direction; a resilient cushion layer including an inner side attached to the backing member segments and an outer side facing outwardly from the backing member segments; the resilient cushion layer including laterally extending grooves extending the resilient cushion member in a direction from the inner side toward the outer side, each the groove located between adjacent segments of the backing member; and an outer protective face comprising a high hardness urethane material supported on the outer side of the resilient cushion layer wherein the outer protective face is formed in a curved shape, curved about a laterally extending axis, maintaining the protective bumper in the curved shape.

DETAILED DESCRIPTION OF THE PREFERRED EMBODIMENT

Figure 1:
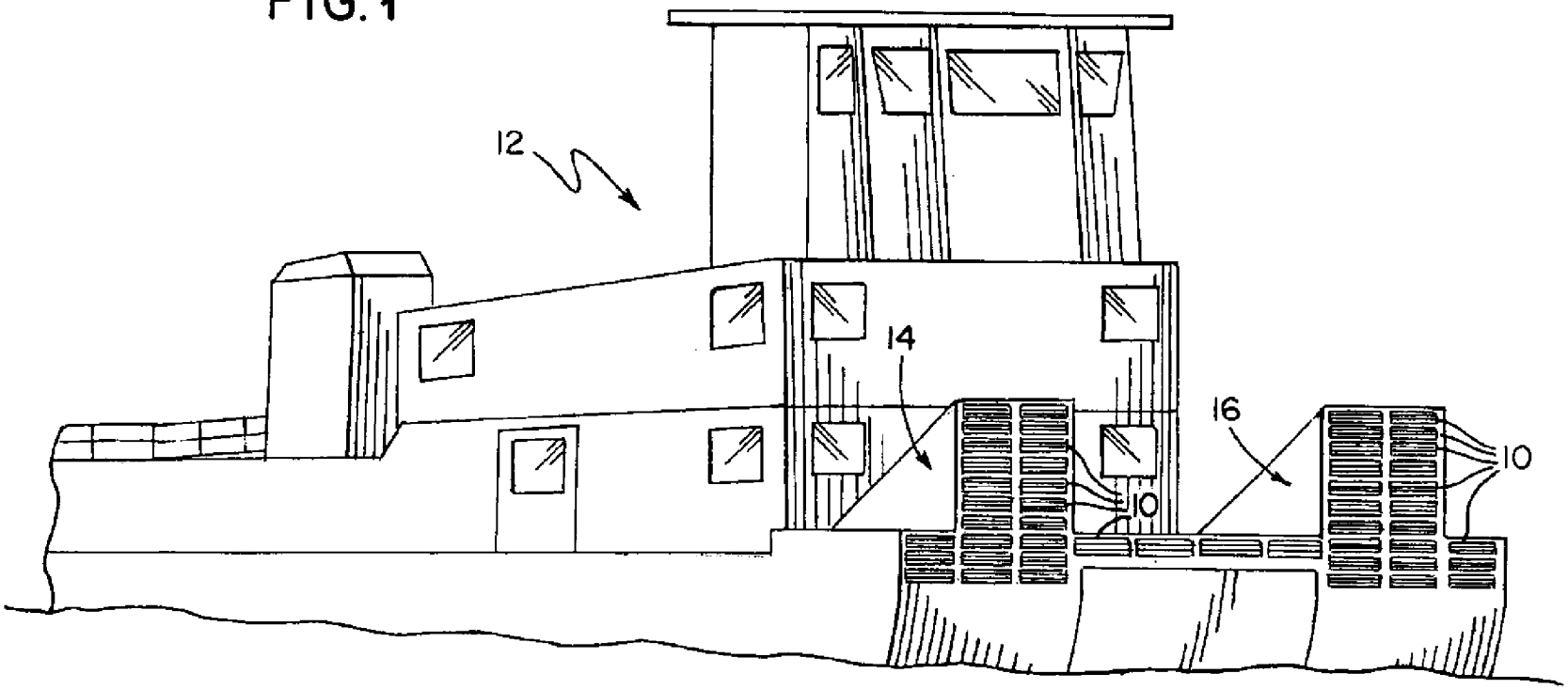
FIG. 1 is a perspective view of a towboat including protective bumpers of the present invention.

Referring to FIG. 1, the present invention provides a protective bumper 10 for a towboat or tugboat, such as a towboat 12 for moving barges on rivers and waterways. The protective bumper 10 is preferably provided for use on a knee bumper 14, 16 and forms a protective member for engaging the side of a barge and for preventing damage to the outer surface of the towboat 12, such as may occur as the towboat 12 engages a barge, as well as a result of vertical and sideways movement of the barge and towboat 12 relative to each other. As seen in FIG. 1, a plurality of the protective bumpers 10 of the present invention may be mounted to an outer surface of the towboat 12.

Figure 2:
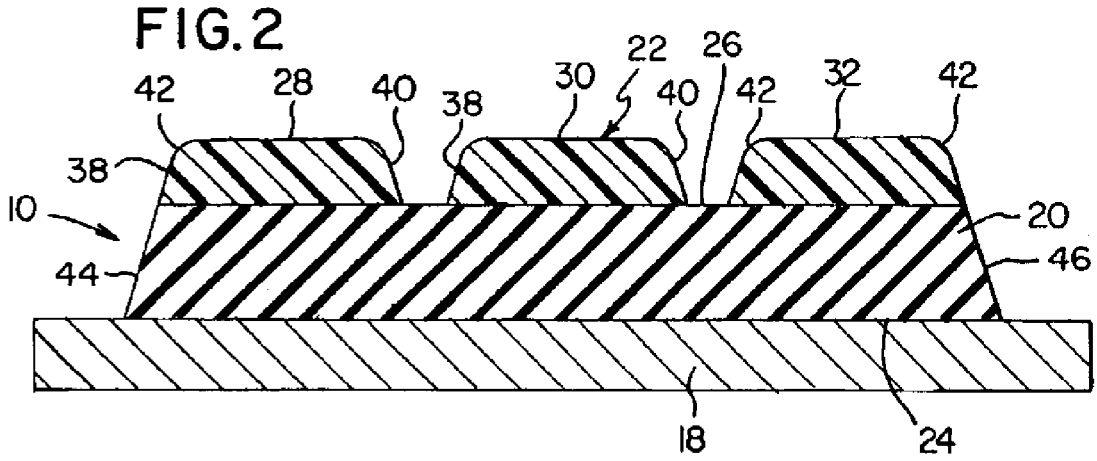
FIG. 2 is a cross-sectional view of a first embodiment of the protective bumper, taken along line 2—2 in FIG. 3.
Figure 3:
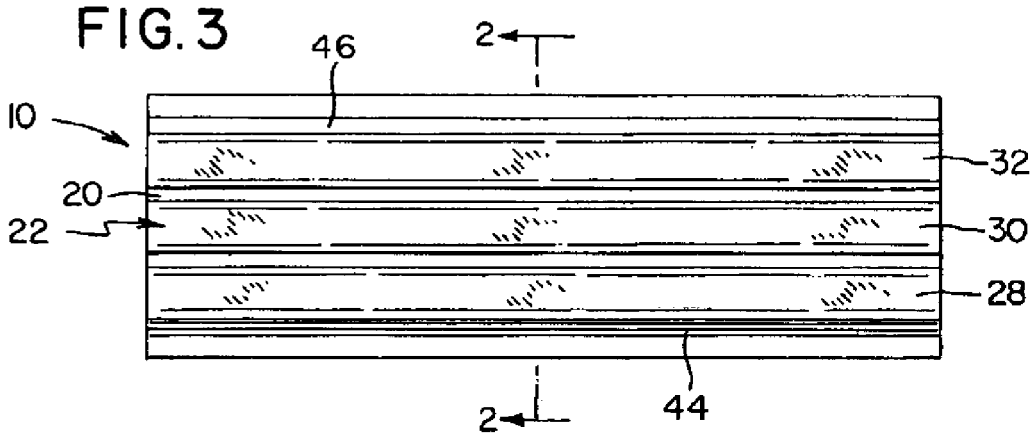
FIG. 3 is a plan view of the protective bumper of the first embodiment.

Referring to FIG. 2, the protective bumper 10 generally comprises a rigid backing member 18, a resilient cushion layer 20 located on the rigid backing member 18, and an outer protective face 22 located on the resilient cushion layer 20. The protective bumper 10 is shown constructed as an elongated member wherein the rigid backing member 18 defines a longitudinal dimension and a lateral dimension for the protective bumper 10 (see also FIG. 3). The rigid backing member 18 of the embodiment shown in FIGS. 2 and 3 comprises a steel plate, such as a 30.48 cm (12 inch)×91.44 cm (36 inch)×1.90 cm (¾ inch) steel plate which may be welded to the outer surface of the towboat 12 at locations where the towboat 12 contacts a barge. Further, it should be understood that the steel plate backing member 18 may be provided in different thicknesses, varying from about one-quarter inch to one inch, depending the requirements of the particular application.

The resilient cushion layer 20 comprises a layer of rubber, such as a natural rubber base having added fillers and carbon black. The resilient cushion layer 20 is preferably formed of 60 Shore A hardness material, and additionally may be formed from an EPDM rubber compound. The resilient cushion layer 20 is approximately 3.175 cm (1¼ inch) thick and includes an inner side 24 attached to an outwardly facing surface of the backing member 18, and an outer side 26 facing outwardly from the backing member 18 and defining a generally planar outer surface. Attachment of the resilient cushion layer 20 to the backing member 18 is accomplished by molding the resilient cushion layer 20 to the backing member 18 during formation of the resilient cushion layer 20.

The protective face 22 comprises a plurality of face segments 28, 30, 32 which define a low friction face for the protective bumper 10. In the illustrated embodiment, the face segments 28, 30, 32 comprise three elongated strips extending in the direction of the longitudinal dimension along the length of the backing member 18. The protective face material preferably has a static coefficient of friction of approximately 0.15 to 0.20 and a dynamic coefficient of friction of approximately 0.10 to 0.14. Specifically, the protective face 22 is preferably formed of ultra high molecular weight polyethylene (UHMWPE). The strips of protective face material are each formed with generally parallel top and bottom surfaces and opposing side surfaces connecting the top and bottom surfaces. The bottom surface is molded to the resilient cushion layer 20 and defines a lateral base dimension of approximately 7.0 cm (2¾ inch), and the top surface defines a lateral dimension of approximately 5.72 cm (2¼ inch). The face segments 28, 30, 32 define a thickness for the outer protective face 22, between the top and bottom surfaces, of approximately 1.91 cm (¾ inch). The side surfaces angle toward each other in the direction from the bottom to the top surface and are joined to the top surface at radiused corners. The radius of the corners is generally equal to or greater than one-third the thickness of the protective face 22, or approximately 0.635 cm (¼ inch) in the illustrated embodiment. The radiused corners are radiused large enough to ensure that the protective face 22 does not include a sharp edge which may cause the protective face 22 to catch and tear during contact with a cooperating surface, such as during engagement with a surface of a barge.

The segments 28, 30, 32 of the protective face 22 are spaced from each other on the outer surface of the resilient cushion layer 20 and, in particular in the illustrated embodiment, the strips of protective face material are spaced from each other in the direction of the lateral dimension between the sides 44, 46 of the resilient cushion layer 20. Each strip or segment 28, 30, 32 of the protective face 22 is able to move independently of the other strips or segments 28, 30, 32 and provides space for the rubber forming the resilient cushion layer 20 to move between the segments 28, 30, 32. Since the rubber material will not compress during engagement of the protective bumper 10 with a cooperating surface, but rather changes shape, the space between the segments 28, 30, 32 of the protective face 22 allows movement of material for relieving stresses in the protective bumper 10 and thereby facilitates isolation of stresses within the protective bumper 10, thus improving the life of the protective bumper 10. For example, when a barge engages and imposes a greater force on one strip or segment 28, 30, 32 of the protective face 22 or on one side of the protective bumper 10, the rubber material in the immediate area of the engaged segment 28, 30, 32 will react to the force while the rubber material supporting other segments 28, 30, 32 of the protective face 22 will remain substantially unaffected by the larger force at the one side of the protective bumper 10. In addition, the low coefficient of friction of the UHMWPE material facilitates sliding of the protective face 22 relative to a cooperating surface to avoid sticking and grabbing of the engaging surface of the protective bumper 10.

The UHMWPE material of the protective face 22 provides a further benefit in that the protective face material can be produced with a bright color, such as a bright yellow color equivalent to safety yellow, for alerting workers of pinch points at the bumper 10.

Figure 4:
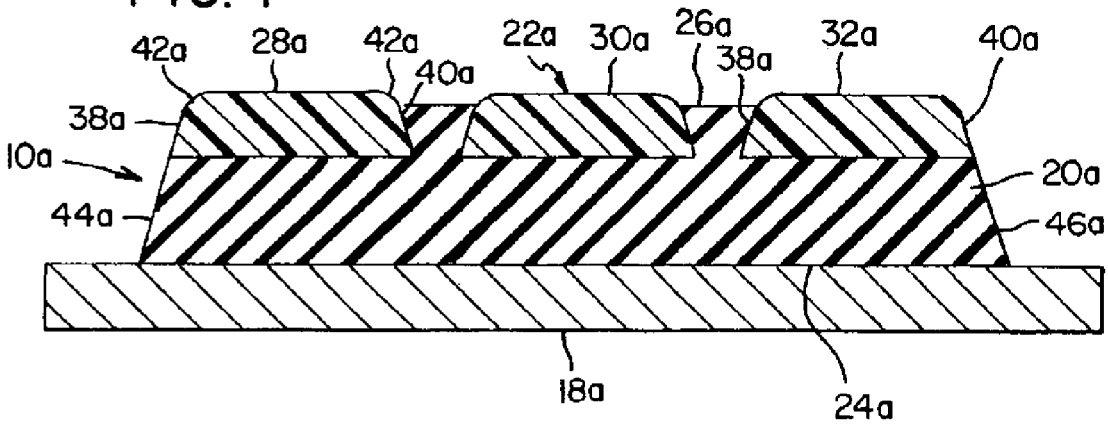
FIG. 4 is a cross-sectional view similar to FIG. 2 taken through a second embodiment of the protective bumper.

Referring to FIG. 4, an alternative embodiment for the protective bumper is illustrated wherein elements of this embodiment are labeled with a reference numeral having an "a" suffix, and elements of the present embodiment corresponding to elements of the first embodiment are identified with the same reference numeral as in the first embodiment. In this embodiment, the protective face 22*a* is formed of segments 28*a*, 30*a*, 32*a* comprising protective strips partially embedded in the resilient cushion layer 20*a*. The segments 28*a*, 30*a*, 32*a* are formed with generally the same dimensions as the first embodiment and, in the illustrated embodiment, approximately 0.318 cm (⅛ inch) of each protective strip or segment 28*a*, 30*a*, 32*a* is exposed above the outer surface of the resilient cushion layer 20*a*. Thus, a substantial portion of the segments 28, 30*a*, 32*a* are embedded within the resilient cushion layer 20*a*. Specifically, greater than half the thickness of each of the segments 28, 30, 32 is embedded within the resilient cushion layer 20*a* to thereby facilitate retention of the segments 28, 30*a*, 32*a* on the protective bumper 10*a* while providing the durable low friction surface of the UHMWPE material.

Figure 5:
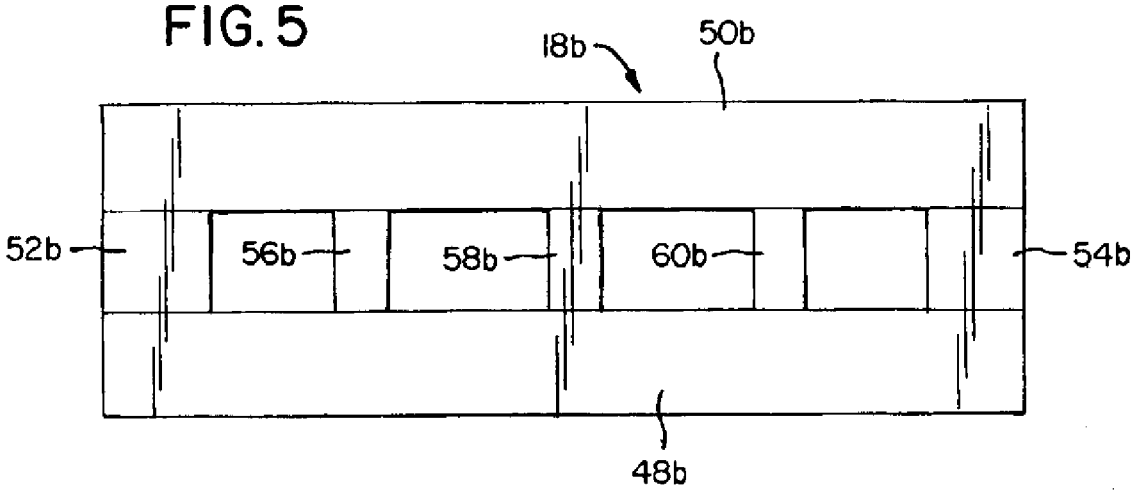
FIG. 5 is a plan view of a frame structure forming a backing member for a third embodiment of the invention.
Figure 6:
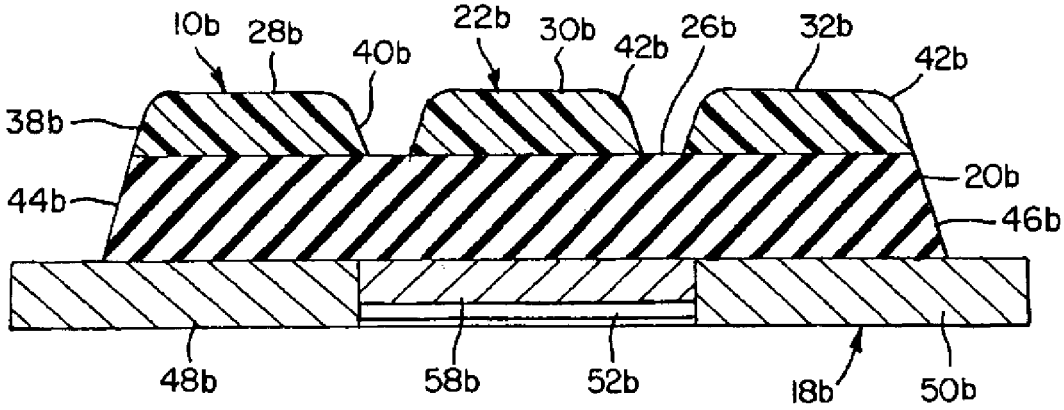
FIG. 6 is cross-sectional view of the protective bumper of the third embodiment incorporating the frame structure shown in FIG. 5.

Referring to FIGS. 5 and 6, an alternative construction for the rigid backing member 18 is illustrated wherein elements of this embodiment are labeled with a reference numeral having a "b" suffix, and elements of the present embodiment corresponding to elements of the first embodiment are identified with the same reference numeral as in the first embodiment. The illustrated backing member 18*b* comprises a frame structure including a pair of spaced longitudinal frame members 48*b*, 50*b*, and a pair of end frame members 52*b*, 54*b* connecting the ends of the longitudinal frame members 48*b*, 50*b*. In addition, a plurality of intermediate connecting members 56*b*, 58*b*, 60*b* are provided, extending laterally between the longitudinal frame members 48*b*, 50*b*. In a specific example of the present embodiment, the longitudinal frame members 48*b*, 50*b* are formed of 1.91 cm (¾ inch)×10.16 cm (4 inch) ×91.44 cm (36 inch) inch) steel and the end frame members 52*b*, 54*b* are formed of 1.91 cm (¾ inch)×10.16 cm (4 inch)×10.16 cm (4 inch) steel to form the main frame portion, and the intermediate members 56*b*, 58*b* 60*b* are formed of 1.27 cm (½ inch)×5.08 cm (2 inch)×10.16 cm (4 inch) steel. The frame structure for the present embodiment reduces the amount of material in the backing member 18*b* and therefore reduces the weight of the protective bumper 10*b* while still providing a rigid backing member 18*b*.

Figure 7:
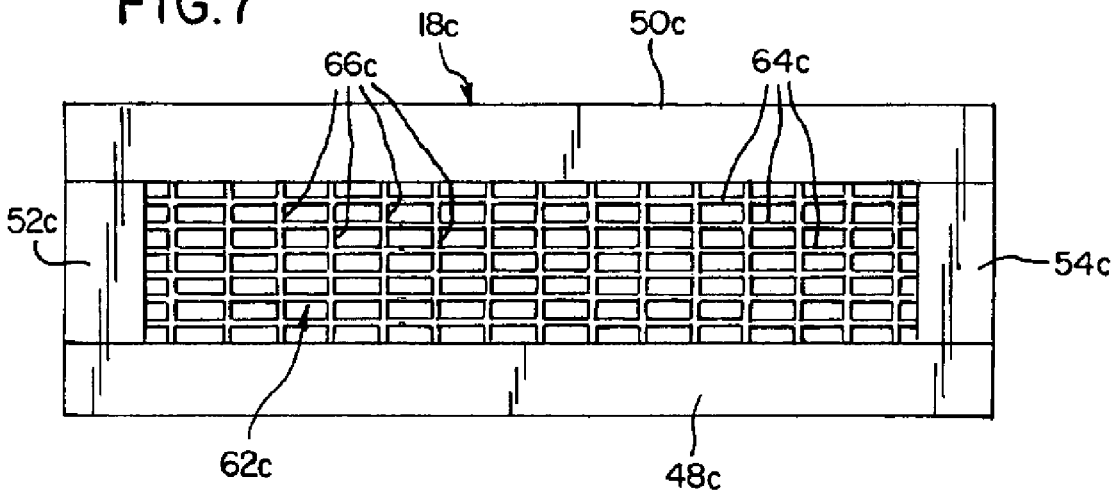
FIG. 7 is a plan view of a frame structure forming a backing member of a fourth embodiment of the invention.
Figure 8:
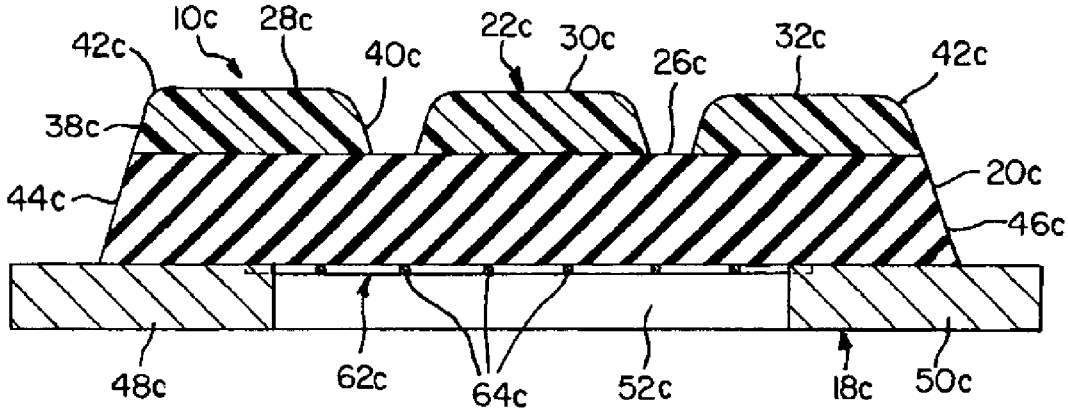
FIG. 8 is a cross-sectional view of the protective bumper of the fourth embodiment incorporating the frame structure shown in FIG. 7.

Referring to FIGS. 7 and 8, a further alternative embodiment for the rigid backing member is illustrated wherein elements of this embodiment are labeled with a reference numeral having a "c" suffix, and elements of the present embodiment corresponding to elements of the previous embodiment are identified with the same reference numeral as in the previous embodiment. In the present embodiment, a pair of longitudinal frame members 48*c*, 50*c* are joined at their ends by a pair of end frame members 52*c*, 54*c* and encompass an area containing a grid structure or grating 62*c*, defined by longitudinal members 64*c* and lateral members 66*c*. The grating 62*c* is attached at its edges to the frame structure formed by the longitudinal frame members 48*c*, 50*c* and end frame members 52*c*, 54*c*. In a specific example of the present embodiment, the longitudinal frame members 48*c*, 50*c* are formed of 1.91 cm (¾ inch)×7.62 cm (3 inch)×91.44 cm (36 inch) steel and the end frame members 52*c*, 54*c* are formed of 1.91 cm (¾ inch)×7.62 cm (3 inch)×10.16 cm (4 inch) steel to form the main frame portion, and the grating portion 62*c* is formed of a 15.24 cm (6 inch)×76.2 cm (30 inch) section of 1.91 cm (¾ inch)×0.31 inch) floor grating. The present embodiment for the frame structure further reduces the weight of the protective bumper 10*c* while providing a durable, rigid backing member 18*c*.

Figure 9:
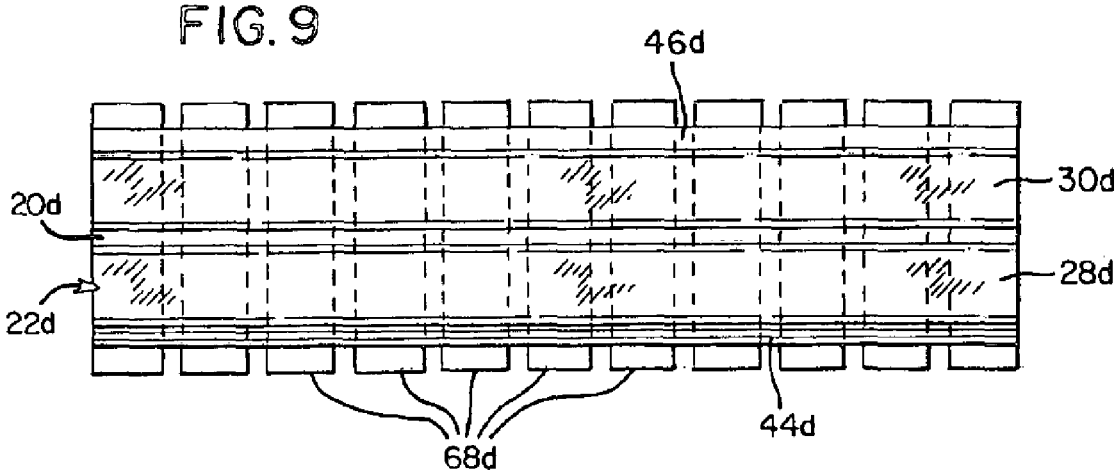
FIG. 9 is plan view of a curved protective bumper of a fifth embodiment of the invention prior to the formation of the protective bumper into a curved structure.
Figure 10:
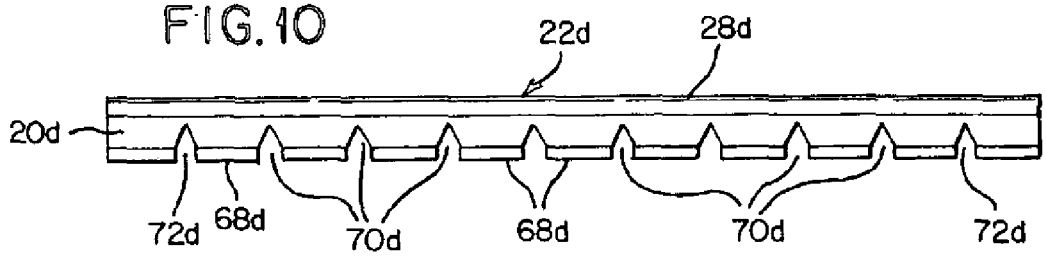
FIG. 10 is a side view of the protective bumper illustrated in FIG. 9.
Figure 11:
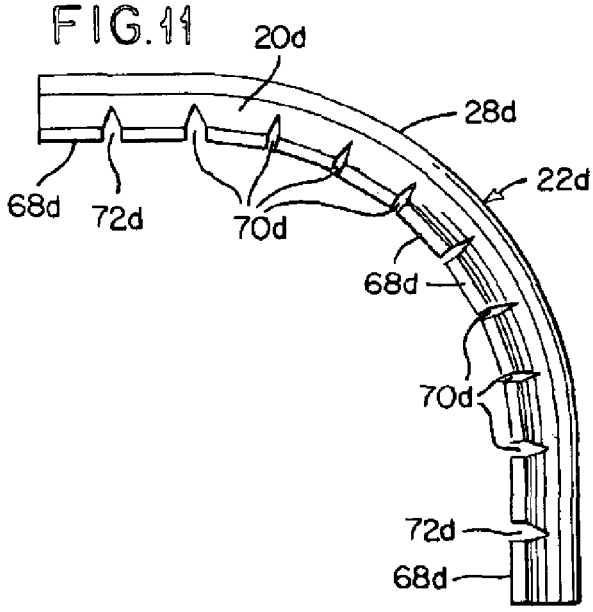
FIG. 11 is a side view of the protective bumper of FIG. 9 after the protective bumper is formed into a predetermined curved shape.

Referring to FIGS. 9–11, a further embodiment of the present invention is illustrated for facilitating protection of corners of the towboat 12 wherein elements of this embodiment are labeled with a reference numeral having a "d" suffix, and elements of the present embodiment corresponding to elements of the first embodiment are identified with the same reference numeral as in the first embodiment. The present embodiment provides a curved bumper 10*d* (FIG. 11) which is preformed to a specific radius, and the bumper 10*d* comprises a backing member 18*d* formed of a plurality of steel member segments 68*d* molded in spaced relation to each other on the inner side 24*d* of a resilient cushion layer 20*d*, which is preferably formed of a rubber material. The steel member segments 68*d* are approximately 6.35 cm (2½ inches)×25.4 cm (10 inches). An outer protective face 22*d* comprising a pair of segments 28*d*, 30*d* defined by protective strips of UHMWPE material are located in spaced relation to each other on an outer side 26*d* of the resilient cushion layer 20*d* and extend the length of the resilient cushion layer 20*d*. The inner side 24*d* of the resilient cushion layer 20*d* is formed with V-grooves 70*d*, 72*d*, elongated in the lateral direction and extending partially into the resilient cushion layer 20*d* approximately 1.91 cm (¾ inch) toward the outer side 26*d*. It should be noted that the grooves 70*d* are preferably 2.22 cm (⅞ inch) wide and the end grooves 72*d* are 1.91 cm (¾such that the grooves 70*d* in the area of substantial bending of the protective bumper 10*d* are larger to accommodate the bending movement.

FIG. 10 illustrates the construction of the protective bumper 10*d* after it is removed from the molding press and prior to formation of the curved shape. At the stage illustrated in FIG. 10, the protective bumper 10*d* is at a temperature of approximately 163° C. (325° F.) and is sufficiently pliable to be formed by placing it in a pre-made form where it is formed to a predetermined curved configuration shown in FIG. 11, curved about an axis extending parallel to the lateral dimension of the bumper 10*d*. The V-groove design of the inner side 24*d* of the resilient cushion layer 20*d* and the segmented backing member 18*d* allow the protective bumper 10*d* to bend in the pre-made form without creating significant residual stress in the resilient cushion layer 20*d*. Further, the UHMWPE material, when heated and formed to the desired shape, will not exhibit residual strain from the forming operation in that the molecules of the UHMWPE material readily relax and reconfigure when at the elevated temperature, such that the protective face 22*d* will maintain the protective bumper 10*d* in the desired curved shape after the bumper 10*d* cools. Also, it should be noted that although the segmented backing member 18*d* provides a reduced rigidity compared to a solid or continuous backing member, the protective face 22*d* serves to add rigidity to the protective bumper 10*d* whereby movement between the resilient cushion layer 20*d* and the backing member segments 68*d* is reduced, reducing the likelihood that the backing member segments 68*d* will separate from the resilient cushion layer 20*d*.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A protective bumper for use on a towboat, said protective bumper comprising:

a rigid backing member defining an elongated longitudinal dimension and a lateral dimension for said protective bumper;

a resilient cushion layer including an inner side attached to said backing member and an outer side facing outwardly from said backing member; and an outer protective face comprising a high hardness urethane material supported on said outer side of said resilient cushion layer wherein said outer protective face is segmented to define plural face segments, wherein each said face segment is attached directly to a surface of said resilient cushion layer and is located in spaced relation to adjacent face segments.

2. The protective bumper of claim 1 wherein said outer protective face comprises plural elongated strips extending along a direction generally parallel to said longitudinal dimension.

3. The protective bumper of claim 2 wherein said plural elongated strips are separated from each other in a direction of said lateral dimension.

4. The protective bumper of claim 1 wherein said outer side of said resilient cushion layer defines a planar surface and said plural face segments are supported on said planar surface.

5. The protective bumper of claim 1 wherein said plural face segments are vulcanized to said outer side of said resilient cushion layer.

6. The protective bumper of claim 1 wherein said plural face segments each comprise generally parallel top and bottom surfaces, said bottom surface located in engagement with said resilient cushion layer, and opposing side surfaces connecting said top and bottom surfaces.

7. The protective bumper of claim 6 wherein said face segments define a thickness for said outer protective face comprising a distance between said top surface and said bottom surface, and said face segments include corners joining said side surfaces to said top surface which are radiused an amount equal to or greater than approximately one-third the thickness of said outer protective face.

8. The protective bumper of claim 1 wherein said plural face segments are embedded within said resilient cushion layer.

9. The protective bumper of claim 8 wherein greater than one-half of each of said plural face segments is embedded in said resilient cushion layer.

10. The protective bumper of claim 1 wherein said rigid backing member comprises a pair of longitudinally extending frame members defining outer longitudinal edges of said protective bumper, and a plurality of longitudinally spaced, laterally extending bars located between said longitudinally extending frame members.

11. The protective bumper of claim 1 wherein said rigid backing member comprises a pair of longitudinally extending frame members defining outer longitudinal edges of said protective bumper, and a grating located between said longitudinally extending frame members.

12. The protective bumper of claim 1 wherein said outer protective face is molded in a curved configuration, curved about an axis extending parallel to the lateral dimension, and said resilient cushion layer is held in said curved configuration by said outer protective face.

13. The protective bumper of claim 12 wherein said resilient cushion layer includes a plurality of laterally extending cut-out portions extending across said inner side.

14. The protective bumper of claim 13 wherein said backing member comprises a plurality of members separated from each other adjacent said cut-out portions in said resilient cushion layer.

15. A protective bumper for use on a towboat, said protective bumper comprising:

a rigid backing member defining an elongated longitudinal dimension and a lateral dimension for said protective bumper;

a resilient cushion layer formed of a rubber material, said resilient cushion layer including an inner side attached to said backing member and an outer side facing outwardly from said backing member, and an outer protective face comprising an ultra high molecular weight polyethylene material supported on said outer side of said resilient cushion layer wherein said outer protective face is segmented to define plural elongated strips, each said elongated strip being attached directly to a surface of said resilient cushion layer and located in spaced relation to adjacent elongated strips, said elongated strips extending along a direction generally parallel to said longitudinal dimension, said elongated strips spaced from each other in a direction of said lateral dimension on said outer side of said resilient cushion material.

16. The protective bumper of claim 15 wherein said rigid backing member comprises a pair of longitudinally extending frame members defining outer longitudinal edges of said protective bumper, and a plurality of longitudinally spaced, laterally extending bars located between said longitudinally extending frame members.

17. The protective bumper of claim 15 wherein said rigid backing member comprises a pair of longitudinally extending frame members defining outer longitudinal edges of said protective bumper, and a grating located between said longitudinally extending frame members.

18. The protective bumper of claim 15 wherein said outer protective face is molded in a curved configuration, curved about an axis extending parallel to the lateral dimension, and said resilient cushion layer is held in said curved configuration by said outer protective face.

19. The protective bumper of claim 18 wherein said resilient cushion layer includes a plurality of laterally extending cut-out portions extending across said inner side.

20. The protective bumper of claim 19 wherein said backing member comprises a plurality of members separated from each other adjacent said cut-out portions in said resilient cushion layer.

21. A protective bumper for use on a towboat, said protective bumper comprising:

a backing member comprising a plurality of rigid segments separated from each other in a longitudinal direction;

a resilient cushion layer including an inner side attached to said backing member segments and an outer side facing outwardly from said backing member segments;

said resilient cushion layer including laterally extending grooves extending into said resilient cushion member in a direction from said inner side toward said outer side, each said groove located between adjacent segments of said backing member; and an outer protective face comprising a high hardness urethane material supported on said outer side of said resilient cushion layer wherein said outer protective face is formed in a curved shape, curved about a laterally extending axis, maintaining said protective bumper in said curved shape.

* * * * *

UNITED STATES PATENT AND TRADEMARK OFFICE

CERTIFICATE OF CORRECTION

PATENT NO. : 6,928,944 B2
DATED : August 16, 2005
INVENTOR(S) : Richard D. Stoll It is certified that error appears in the above-identified patent and that said Letters Patent is hereby corrected as shown below:

Column 5,
Line 32, "(4 inch) x 91.44 cm (36 inch) inch) steel" should read
-- (4 inch) x 91.44 cm (36 inch) steel --.
Line 62, "(3/4 inch) x 0.31 inch) floor grating." should read
-- (3/4 inch) x 0.318 cm (1/8 inch) floor grating. --.

Column 6,
Line 24, "1.91 cm (3/4such that the grooves 70d in the area", should read
-- 1.91 cm (3/4 inch) wide, such that the grooves 70d in the area --.

Signed and Sealed this

Twenty-eighth Day of March, 2006

JON W. DUDAS
*Director of the United States Patent and Trademark Office*